US007087094B2

(12) United States Patent
Galick et al.

(10) Patent No.: US 7,087,094 B2
(45) Date of Patent: Aug. 8, 2006

(54) DRYCLEANING METHOD USING DIPROPYLENE GLYCOL N-PROPYL ETHER

(75) Inventors: Paul E. Galick, West Chester, PA (US); Larry W. Arndt, West Chester, PA (US); Shao-Hua Guo, Exton, PA (US); Ellen S. Lenz, West Chester, PA (US); David R. Kinney, West Grove, PA (US)

(73) Assignee: Lyondell Chemical Technology, L.P., Greenville, DE (US)

( * ) Notice: Subject to any disclaimer, the term of this patent is extended or adjusted under 35 U.S.C. 154(b) by 339 days.

(21) Appl. No.: 10/653,725

(22) Filed: Sep. 2, 2003

(65) Prior Publication Data

US 2005/0044636 A1 Mar. 3, 2005

(51) Int. Cl.
*D06L 1/02* (2006.01)

(52) U.S. Cl. ..... 8/142; 510/285; 510/291

(58) Field of Classification Search ..... 134/12; 510/285, 291; 8/142
See application file for complete search history.

(56) References Cited

U.S. PATENT DOCUMENTS

| | | | | |
|---|---|---|---|---|
| 5,876,510 | A * | 3/1999 | Kuemin et al. | 134/12 |
| 6,086,634 | A * | 7/2000 | Smith | 8/142 |
| 6,172,031 | B1 | 1/2001 | Stevens | 510/417 |
| 6,828,292 | B1 | 12/2004 | Noyes et al. | 510/287 |

FOREIGN PATENT DOCUMENTS

| | | |
|---|---|---|
| WO | WO 01/16422 | 3/2001 |
| WO | WO 01/94678 | 12/2001 |

* cited by examiner

*Primary Examiner*—Gregory Delcotto
*Assistant Examiner*—Preeti Kumar
(74) *Attorney, Agent, or Firm*—Jonathan L. Schuchardt; John Calve

(57) ABSTRACT

A drycleaning method is disclosed. In the method, a composition that comprises dipropylene glycol n-propyl ether (DPnP) and is essentially free of siloxanes or polysulfonic acids is used. The composition contains at least about 80 wt. % DPnP and up to about 15 wt. % of water. The method enables superior stain removal while avoiding excessive fabric shrinkage or soil redeposition.

11 Claims, No Drawings

DRYCLEANING METHOD USING DIPROPYLENE GLYCOL N-PROPYL ETHER

FIELD OF THE INVENTION

The invention relates to a method for drycleaning fabrics and fibers. In particular, the invention is a drycleaning method that uses a composition containing dipropylene glycol n-propyl ether.

BACKGROUND OF THE INVENTION

Conventional methods for drycleaning use a chlorinated hydrocarbon solvent, most commonly perchloroethylene (PERC) in combination with small amounts of water and detergents. While PERC is fabric-safe, non-flammable, and easily recycled, it has come under attack in recent years as an environmental and health hazard. In particular, PERC is listed as a Hazardous Air Pollutant (HAP), it is non-biodegradable, and it is a probable human carcinogen.

In recent years, the industry has responded with less-toxic alternatives to PERC, including hydrocarbons (e.g., EcoSolv™ drycleaning fluid from CPChem) and glycol ethers. One glycol ether, dipropylene glycol n-propyl ether (DPnP), has been used in combination with other essential components. For example, DPnP has been used with a polysulfonic acid, a substrate, and other components (see, e.g., U.S. Pat. Nos. 6,086,634 and 6,036,727) for at-home drycleaning in a conventional clothes dryer. The polysulfonic acid is a critical component that aids in cleaning and freshening the soiled fabric.

Another environmentally friendly alternative to PERC, available from GreenEarth Cleaning, uses a cyclic siloxane, optionally in combination with a glycol ether (which may be DPnP) or another organic solvent (see, e.g., U.S. Pat. Nos. 6,042,617 and 6,063,135). The cyclic siloxane has a desirable flash point, fabric-safe qualities, and good solvency for oily soils. While they do have low toxicity, siloxanes have relatively low cleaning power and are preferably avoided.

Other glycol ethers have been recommended for use in drycleaning, most notably propylene glycol tert-butyl ether (PTB), propylene glycol n-butyl ether (PNB), dipropylene glycol tert-butyl ether (DPTB) and dipropylene glycol n-butyl ether (DPNB). See, for example, U.S. Pat. Nos. 5,888,250, 6,156,074, 6,273,919, and 6,350,287, all assigned to Rynex Holdings, Ltd. In particular, the '919 and '287 patents teach DPTB as an alternative with significant advantages over PERC. DPTB has a high flash point and good detergency. The compositions taught for use are DPTB/water (>9:1 by weight) mixtures. The use of glycol ethers, including DPTB, represents a significant step toward replacing PERC in drycleaning.

Good progress has been made to date, but the industry continues to need a better replacement for PERC. In particular, the industry would benefit from ways to dryclean fabrics and fibers with fluids that are also free of siloxanes, polysulfonic acids, or other complex or expensive components. An improved drycleaning method would be effective for both oily soils (e.g., butter or animal fat) and more water-soluble soils (e.g., tea or blood). Always of interest, especially to parents of young children, is a cleaning method that is more effective for removing grass stains. Preferably, the cleaning method would help to prevent redeposition of soils (a problem for PERC if PERC is used without detergents). An ideal cleaner would use readily available, inexpensive components, and would outperform commercially available alternatives to PERC such as those based on hydrocarbons or DPTB. Finally, the cleaning method must not harm the fabric. In particular, the method must not cause undue shrinkage (i.e., more than about 2%).

SUMMARY OF THE INVENTION

The invention is a method for drycleaning a fabric or fiber. The method comprises using a composition comprising at least about 80 wt. % of dipropylene glycol n-propyl ether (DPnP) wherein the composition is essentially free of siloxanes and polysulfonic acids. The composition can contain up to about 15 wt. % of water without promoting undue shrinkage.

We surprisingly found that DPnP can be used without siloxanes or polysulfonic acids in drycleaning with excellent results. The method has improved effectiveness compared with PERC and its commercial replacements for removing oily and water-soluble soils. Moreover, the method is outstanding for removing grass stains. The method avoids soil redeposition, and uses readily available, inexpensive components. In sum, the method offers improved cleaning power across a wide spectrum of common stain types while providing a fabric-safe, environmentally acceptable alternative to PERC.

DETAILED DESCRIPTION OF THE INVENTION

The method of the invention is used for drycleaning fabrics. Suitable fabrics include any textile articles that benefit from the drycleaning process. They include products made from a wide variety of natural and synthetic fibers, including, e.g., cotton, wool, silk, rayon, polyester, nylon, acetates, polyolefins, acrylics, spandex, and the like, and blends of these. Suitable fabric uses include garments and accessories, bedding, furniture coverings, rugs, wall coverings, draperies, napkins, tablecloths, and so on. The method can also be used to dryclean fibers, including wool fiber, before it is used to make a fabric.

The method of the invention uses dipropylene glycol n-propyl ether (DPnP) as a solvent. DPnP is normally produced as a mixture of isomers, which may have a primary or secondary hydroxyl group, and may have head-to-head or head-to-tail configuration of the oxypropylene groups. The major isomer usually has a secondary hydroxyl group. All of the DPnP isomers have molecular formula $C_9H_{20}O_3$. Minor amounts of other compounds generated as by-products in the manufacture of DPnP may also be present. DPnP is commercially available as Dowanol® DPnP from the Dow Chemical Company and as ARCOSOLV® DPnP from Lyondell Chemical Company.

Compositions useful in practicing the method of the invention have at least about 80 wt. % of DPnP. More preferably, the compositions have at least about 90 wt. %, and most preferably at least about 95 wt. % of DPnP. The compositions are essentially free of cyclic siloxanes (see, e.g., U.S. Pat. No. 6,042,617) and polysulfonic acids (see, e.g., U.S. Pat. No. 6,086,634). By "essentially free," we mean that the compositions contain less than 0.1 wt. % of each of these components, and preferably 0 wt. %. We found that these components are not needed for achieving excellent drycleaning with DPnP.

The compositions contain up to about 15 wt. % water. Water helps to dissolve many soils, particularly those with substantial water solubility such as blood or tea. Too much water in the drycleaning formulation should be avoided, however, because it will cause many fabrics (e.g., cotton or wool) to shrink. Thus, preferred compositions have up to about 10 wt. % water. See, for example, the results in Table 2 below. Shrinkage values greater than about 2% are generally undesirable. The formulation with 85 wt. % DPnP and 15 wt. % water results in shrinkage in excess of 4% in the case of a worsted flannel fabric.

Optionally, the compositions contain additional components commonly used in the drycleaning industry. For example, the compositions can include other organic solvents, such as other glycol ethers, glycol esters, glycol ether esters, alcohols (especially $C_8$–$C_{12}$ aliphatic alcohols), hydrocarbons, or the like, and mixtures thereof. The compositions can also contain detergents, anti-static agents, surfactants, fabric softeners, brighteners, disinfectants, anti-redeposition agents, fragrances, and the like. For some examples of conventional additives, see U.S. Pat. No. 6,086,634, the teachings of which are incorporated herein by reference.

A variety of well-known drycleaning techniques can be employed. In a typical commercial process, garments are rotated in a tumble-type washer that contains a drycleaning solvent, detergents, and other additives. Cleaning composition is drained from the tumbler, and the garments are spun to remove most of the liquid. The garments are then tumbled in heated air in a dryer to remove remaining traces of cleaning fluid. The cleaning composition is reused after purifying it by adsorption, distillation, or a combination of these methods. The method of the invention is also expected to have value for home drycleaning applications.

Cleaning power is of paramount importance to the industry, and DPnP is highly effective for removing a wide spectrum of common stain types. Preliminary results, reported in Table 1 below, suggested that DPnP/water (95:5) mixtures have considerable stain-removing capability. A later, more-comprehensive investigation, summarized in Table 3, provides even more striking results. In terms of stain index, measured and calculated as described below, a DPnP/water (95:5) mixture outperformed all other tested cleaners (including a hydrocarbon cleaner and DPTB-based cleaners).

In particular, the DPnP/water mixture was the best at removing eight of fifteen tested stains, including butter, clay, baby food, grass, red dye/animal fat, peat, red wine, and curry. The performance on the grass stain is especially noteworthy. Moreover, only water outperformed the DPnP/water mixture for effectiveness in removing four other stains: tea, spaghetti sauce, blood, and dessert. Because water can only be tolerated to a limited degree in drycleaning (usually 10% or less), the DPnP/water (95:5) mixture is effectively the drycleaning solvent of choice for twelve of the fifteen stains.

Table 4 shows the aggregate improvement due to using DPnP. Overall, compared with other cleaners, DPnP removed 39–167% more stain.

Importantly, DPnP does not promote shrinkage. As the results in Table 2 demonstrate, greater shrinkage results from exposure of the fabric to increasing amounts of water. However, a DPnP/water (90:10) mixture still gave an acceptable shrinkage of <2% with a worsted flannel fabric.

The method demonstrates good detergency properties. DPnP provides improved effectiveness compared with PERC not only in terms of stain removal power, but also in terms of soil redeposition. As the whiteness index (WI) numbers in Table 3 indicate, PERC had the lowest overall WI value (64.4), which is a reflection of PERC's tendency to remove very oily soils (e.g., engine oil) and then, in the absence of a detergent, allow them to redeposit on the fabric. In contrast, the DPnP/water (95:5) mixture showed a high WI of 97.9. Even without a detergent, the DPnP/water mixture removes soils well and keeps them from redepositing on the fabric.

The invention uses readily available, inexpensive components. As the results demonstrate, no cyclic siloxanes or polysulfonic acids need to be used with DPnP to achieve excellent drycleaning results. In sum, the method offers improved cleaning power across a wide spectrum of common stain types while providing a fabric-safe, environmentally acceptable alternative to PERC.

The following examples merely illustrate the invention. Those skilled in the art will recognize many variations that are within the spirit of the invention and scope of the claims.

Test Methods

A. Stain/Soil Cleaning Method

A standard undyed cotton cloth having fifteen different stains (EMPA multistain, supplied by Testfabrics, Inc.) is stapled to a 22×22-cm stainless-steel screen. The mounted cloth is placed inside a one-gallon container, and the cleaning fluid of interest (600 g) is added. The container is sealed, placed on a mechanical roller, and rotated for 10 minutes at a roller speed of 30 revolutions per minute (rpm). As the container rotates, the cleaner drains through the cloth and removes the stains. The fabric is allowed to drain and is then dried overnight at room temperature. The APHA color of the cleaner solution is measured using a Hunter calorimeter or its equivalent. Total color removal results appear in Table 1.

B. Shrinkage Test Method

A square pattern (19×19 cm) is drawn on a worsted flannel cloth (neutral; oil content <0.5 wt. %; available from Testfabrics, Inc.). The dimensions of the marks in both the warp (length of fabric) and weft (width of fabric) directions are measured. The cloth is then immersed in 600 g of cleaner and rolled for 10 minutes at 30 rpm (without attaching the cloth to a steel screen). The cloth is then removed from the liquid, excess cleaner is allowed to drain, and the damp cloth is oven dried at 120° F. for 30 minutes, then allowed to dry overnight at room temperature. The dimensional change of the square pattern is then determined by measuring the pattern length in both warp and weft directions. In each case, the percent dimensional change=[(A−B)/A]×100, where A is the original dimension, and B is the dimension after cleaning. Results of shrinkage testing appear in Table 2.

C. Stain Index Method

In addition to measuring the APHA color of the cleaner solutions, we also analyzed each of the individual stains on the treated cloth samples using a HunterQuest II calorimeter and the following parameters: Color scale: CIE L*a*b*. Illuminant: D65 (simulates noon sunlight). Observer angle: 10 degrees. All measurements were performed in Reflectance-Specular Included mode.

Whiteness index (WI) is given by:

$$WI=0.01\times L^*(L^*-5.7\,b^*)$$

where 100=MgO white, and 0=black.

Stain index (SI) is given by:

$$SI=[100-L^*]+[abs(a^*)+abs(b^*)]$$

where 0=MgO white, 160=saturated red-orange.

The lowest SI values (indicating optimum stain removal) will be observed when color saturation is lowest (i.e., when the absolute values of a* and b* approach 0) and when whiteness index is highest (L* approaches 100). On the L*,a*,b* color solid scale used by HunterLab (Reston, Va.), the L* axis represents light and dark with L*=100 for white and 0 for black. On the a* axis, a positive value represents red coloring and a negative value represents green. The greater the absolute value, the greater the color saturation. On the b* axis, a positive value represents yellow and a negative value represents blue.

The SI value can approach 0 at its lowest. Theoretically, the SI value can be as high as 160 (a saturated red-orange color), because the highest values for L*, abs(a*), and abs(b*) are 60, 60, and 40 respectively. As a practical matter, however, the highest observed values will approach 100 because the human eye typically cannot detect colors at the highest color saturation levels.

Test samples are placed on telescope rings to flatten the fabric. A white tile is placed behind the cloth during measurements to ensure consistent results. After an initial measurement, the cloth is rotated 90 degrees and a second measurement is made. The results are averaged to report a single number for L*, a*, or b* (see Tables A–C). This technique reduces any direction-dependent texture effects from the fabric. The values obtained for L*, a*, and b* are used to calculate stain index (SI) and whiteness index (WI) by ASTM E313 as described earlier.

Sample Calculations

1. Whiteness index for DPnP/water (95:5) using measured values for "No Stain" for L* and b* from Tables A and C:

$$WI=0.01\times L^*(L^*-5.7b^*)$$

$$WI=0.01\times 95.2[95.2-(5.7)(-1.35)]$$

$$WI=0.01\times 95.2[95.2+7.695]=97.9$$

2. Stain index for DPnP/water (95:5), grass stain, using measured values for L*, a*, and b* from Tables A, B, and C:

$$SI=[100-L^*]+[abs(a^*)+abs(b^*)]$$

$$SI=[100-93.0]+[abs(-0.28)+abs(3.71)]$$

$$SI=7.0+0.28+3.71=11.0$$

3. Average stain index for DPnP water (95:5) using SI values from Table 3:

$$\text{Ave SI}=[\text{sum of all SI values measured}]/15 \text{ stains}$$

$$\text{Ave SI}=[46.4+9.1+30.7 \ldots +65.6]/15=512.5/15=34.2$$

4. Percent improvement from DPnP/water (95:5):

$$\%\text{ improvement in average stain index due to } DPnP=100\times abs[(SI_{control}-SI_{comp})-(SI_{control}-SI_{DPnP})]/(SI_{control}-SI_{comp})$$

where the SI values are average stain indices for DPnP/water 95:5 (34.2), the control (48.9), and the comparative solvents.

Simplifying:

$$\%\text{ improvement}=abs[(SI_{DPnP}-SI_{comp})]/(SI_{control}-SI_{comp})\times 100$$

For DPnP/water (95:5) versus Rynex/water (95:5):

$$\%\text{ improvement}=abs[(34.2-38.3)]/(48.9-38.3)\times 100=39\%$$

For DPnP/water (95:5) versus EcoSolv™ DCF:

$$\%\text{ improvement}=abs[(34.2-43.4)]/(48.9-43.4)\times 100=167\%$$

TABLE 1

Total Color Removal Results

| Cleaner | Final APHA color of cleaner |
|---|---|
| Water | 160 |
| PERC | 111 |
| DPnP/water (95:5) | 90 |
| EcoSolv DCF | 70 |
| Rynex/water (90:10) | 54 |

TABLE 2

Shrinkage Results

| Cleaner | % shrinkage, length | % shrinkage, width |
|---|---|---|
| DPnP | 0 | 0 |
| DPnP/water (95:5) | 0.13 | 0.06 |
| DPnP/water (90:10) | 0.87 | 1.63 |
| DPnP/water (85:15) | 4.58 | 4.00 |
| Rynex/water (90:10) | 2.85 | 2.71 |

TABLE 3

Stain Index Results

| CLEANER | Oil | Butter | Clay | Baby Food | Tea | β-Carotene | Grass | Red Dye/ Animal Fat |
|---|---|---|---|---|---|---|---|---|
| Control | 53.2 | 37.8 | 35.0 | 25.7 | 49.6 | 5.8 | 29.4 | 85.5 |
| DPnP/water (95:5) | 46.4 | 9.1 | 30.7 | 22.6 | 40.7 | 5.9 | 11.0 | 7.3 |
| Rynex[1]/water (95:5) | 48.5 | 14.1 | 34.4 | 25.5 | 43.2 | 8.3 | 14.2 | 13.5 |
| Rynex/water (90:10) | 51.3 | 11.9 | 34.9 | 25.8 | 42.6 | 5.8 | 31.4 | 26.3 |
| Water | 62.7 | 26.4 | 37.0 | 31.6 | 37.2 | 16.2 | 31.4 | 68.4 |
| PERC | 25.9 | 11.7 | 39.2 | 34.4 | 53.9 | 12.4 | 42.5 | 14.7 |
| EcoSolv DCF[2] | 36.0 | 11.8 | 40.1 | 33.7 | 52.8 | 5.6 | 41.2 | 13.5 |
| DPnP/water RANK--> | 3 | 1 | 1 | 1 | 2 | 4 | 1 | 1 |

| CLEANER | Spaghetti Sauce | Blood | Dessert | Peat | Red Wine | Curry | Make-up | Whiteness Index |
|---|---|---|---|---|---|---|---|---|
| Control | 39.0 | 69.4 | 69.8 | 39.3 | 46.5 | 68.3 | 78.9 | 102 |
| DPnP/water(95:5) | 27.2 | 58.1 | 62.8 | 38.2 | 38.2 | 48.7 | 65.6 | 97.9 |

TABLE 3-continued

| Stain Index Results | | | | | | | | | |
|---|---|---|---|---|---|---|---|---|---|
| Rynex/water | (95:5) | 35.3 | 63.6 | 70.8 | 44.0 | 42.3 | 60.2 | 56.7 | 99.3 |
| Rynex/water | (90:10) | 31.4 | 63.3 | 75.3 | 39.2 | 47.1 | 57.4 | 66.4 | 89.8 |
| Water | | 23.3 | 44.0 | 60.9 | 38.8 | 41.3 | 61.9 | 58.9 | 81.5 |
| PERC | | 40.5 | 69.6 | 74.9 | 42.4 | 54.2 | 66.1 | 66.9 | 64.4 |
| EcoSolv | DCF | 39.5 | 71.2 | 73.1 | 40.3 | 58.3 | 66.5 | 67.0 | 94.3 |
| DPnP/waterRANK--> | | 2 | 2 | 2 | 1 | 1 | 1 | 3 | 3 |

[1]Rynex fluid is a DPTB-based cleaner commercially available from Rynex Holdings.
[2]EcoSolv DCF is a hydrocarbon-based cleaner commercially available from CP Chem.

TABLE A

Measured L* values

| CLEANER | Oil | Butter | Clay | Baby Food | Tea | β-Carotene | Grass | Red Dye/ Animal Fat |
|---|---|---|---|---|---|---|---|---|
| Control | 52.1 | 83.0 | 79.8 | 87.9 | 78.6 | 95.5 | 87.3 | 64.5 |
| DPnP/water (95:5) | 57.3 | 93.8 | 81.9 | 89.4 | 84.0 | 95.0 | 93.0 | 94.5 |
| Rynex/water (95:5) | 56.0 | 92.0 | 80.0 | 88.3 | 82.7 | 92.9 | 92.1 | 92.8 |
| Rynex/water (90:10) | 52.6 | 92.8 | 78.3 | 87.5 | 81.8 | 95.0 | 87.2 | 87.7 |
| Water | 46.0 | 86.7 | 77.0 | 83.5 | 80.5 | 90.4 | 83.9 | 70.8 |
| PERC | 77.7 | 90.9 | 74.2 | 82.2 | 73.7 | 89.5 | 77.3 | 88.6 |
| EcoSolv DCF | 68.0 | 92.4 | 74.7 | 84.7 | 76.7 | 94.4 | 81.7 | 90.9 |

| CLEANER | Spaghetti Sauce | Blood | Dessert | Peat | Red Wine | Curry | Make-up | No Stain |
|---|---|---|---|---|---|---|---|---|
| Control | 83.1 | 45.5 | 55.8 | 72.9 | 76.8 | 75.0 | 52.4 | 95.7 |
| DPnP/water (95:5) | 87.9 | 53.3 | 60.0 | 74.2 | 83.0 | 80.3 | 62.3 | 95.2 |
| Rynex/water (95:5) | 85.1 | 48.7 | 55.1 | 70.7 | 80.7 | 76.9 | 69.4 | 95.3 |
| Rynex/water (90:10) | 86.5 | 48.8 | 51.4 | 73.2 | 80.2 | 75.5 | 62.1 | 94.5 |
| Water | 88.5 | 72.0 | 58.7 | 73.8 | 78.0 | 73.2 | 66.1 | 94.0 |
| PERC | 77.7 | 44.1 | 49.4 | 69.6 | 71.9 | 69.1 | 59.1 | 83.0 |
| EcoSolv DCF | 82.3 | 43.2 | 52.6 | 72.3 | 74.4 | 72.2 | 61.9 | 94.4 |

TABLE B

Measured a* values

| CLEANER | Oil | Butter | Clay | Baby Food | Tea | β-Carotene | Grass | Red Dye/ Animal Fat |
|---|---|---|---|---|---|---|---|---|
| Control | 0.084 | 3.79 | 2.26 | 3.12 | 6.72 | −0.47 | −3.41 | 38.9 |
| DPnP/water (95:5) | 0.84 | 0.38 | 2.05 | 2.58 | 4.09 | −0.33 | −0.28 | 1.72 |
| Rynex/water (95:5) | 0.92 | 1.31 | 2.29 | 2.95 | 4.73 | 0.69 | −0.35 | 5.13 |
| Rynex/water (90:10) | 1.02 | 0.63 | 2.18 | 3.61 | 5.15 | −0.02 | 0.65 | 11.0 |
| Water | 2.02 | 1.30 | 2.41 | 3.84 | 4.12 | 0.03 | 0.37 | 29.4 |
| PERC | 1.07 | −0.11 | 2.16 | 4.53 | 6.72 | 0.65 | −0.45 | 1.38 |
| EcoSolv DCF | 1.13 | 0.25 | 2.39 | 5.22 | 7.50 | 0.0 | −0.85 | 2.81 |

| CLEANER | Spaghetti Sauce | Blood | Dessert | Peat | Red Wine | Curry | Make-up | No Stain |
|---|---|---|---|---|---|---|---|---|
| Control | 3.55 | 6.83 | 11.3 | 3.18 | 11.3 | 6.21 | 11.8 | 0.09 |
| DPnP/water (95:5) | 1.90 | 1.51 | 9.64 | 3.27 | 7.09 | 3.20 | 9.02 | 0.28 |
| Rynex/water (95:5) | 2.81 | 3.28 | 11.2 | 3.77 | 8.92 | 3.84 | 7.44 | 0.28 |
| Rynex/water (90:10) | 2.82 | 2.80 | 11.6 | 3.22 | 10.8 | 5.30 | 9.63 | 0.21 |
| Water | 1.17 | 1.45 | 8.60 | 3.14 | 7.83 | 4.20 | 8.93 | 0.14 |
| PERC | 2.72 | 4.44 | 10.5 | 3.00 | 11.0 | 4.68 | 8.68 | 1.04 |
| EcoSolv DCF | 3.67 | 4.95 | 11.2 | 3.21 | 14.6 | 5.79 | 9.76 | 0.16 |

TABLE C

Measured b* values

| CLEANER | Oil | Butter | Clay | Baby Food | Tea | β-Carotene | Grass | Red Dye/ Animal Fat |
|---|---|---|---|---|---|---|---|---|
| Control | 5.22 | 17.1 | 12.5 | 10.5 | 21.5 | 0.81 | 13.2 | 11.1 |
| DPnP/water (95:5) | 2.84 | 2.48 | 10.6 | 9.38 | 20.6 | −0.61 | 3.71 | −0.078 |

TABLE C-continued

| Measured b* values | | | | | | | | |
|---|---|---|---|---|---|---|---|---|
| Rynex/water (95:5) | 3.58 | 4.71 | 12.1 | 10.8 | 21.2 | 0.47 | 5.94 | −1.11 |
| Rynex/water (90:10) | 2.90 | 4.03 | 11.0 | 9.67 | 19.2 | −0.80 | 18.0 | 2.91 |
| Water | 6.62 | 11.8 | 11.6 | 11.2 | 13.6 | 6.64 | 15.0 | 9.71 |
| PERC | 2.57 | 2.50 | 11.3 | 12.1 | 20.8 | 1.23 | 19.4 | 1.89 |
| EcoSolv DCF | 2.88 | 3.93 | 12.4 | 13.2 | 22.1 | −0.04 | 22.0 | 1.50 |

| CLEANER | Spaghetti Sauce | Blood | Dessert | Peat | Red Wine | Curry | Make-up | No Stain |
|---|---|---|---|---|---|---|---|---|
| Control | 18.5 | 8.06 | 14.3 | 9.03 | 12.0 | 37.2 | 19.5 | −1.91 |
| DPnP/water (95:5) | 13.1 | 9.84 | 13.1 | 9.16 | 14.1 | 25.8 | 19.0 | −1.35 |
| Rynex/water (95:5) | 17.6 | 9.07 | 14.6 | 10.9 | 14.0 | 33.3 | 18.6 | −1.56 |
| Rynex/water (90:10) | 15.1 | 9.25 | 15.1 | 9.18 | 16.6 | 27.5 | 18.8 | −0.08 |
| Water | 10.6 | 14.5 | 11.0 | 9.41 | 11.5 | 30.9 | 16.0 | 1.30 |
| PERC | 15.5 | 9.17 | 13.8 | 9.07 | 15.0 | 30.5 | 17.3 | 0.96 |
| EcoSolv DCF | 18.1 | 9.46 | 14.5 | 9.36 | 18.1 | 33.0 | 19.1 | −0.98 |

TABLE 4

| Stain Index: Average Composite Values, Relative Rank, and % Improvement from DPnP | | | |
|---|---|---|---|
| Cleaner | Ave. Stain Index | Rank | DPnP's % Improvement |
| control | 48.9 | — | — |
| DPnP/water (95:5) | 34.2 | 1 | — |
| Rynex/water (95:5) | 38.3 | 2 | 39 |
| Rynex/water (90:10) | 40.7 | 3 | 79 |
| Water | 42.7 | 4 | 137 |
| PERC | 43.3 | 5 | 162 |
| EcoSolv DCF | 43.4 | 6 | 167 |

The preceding examples are meant only as illustrations. The following claims define the invention.

We claim:

1. A method which comprises drycleaning a fabric or fiber using a composition comprising water and at least 95 wt. % of dipropylene glycol n-propyl ether (DPnP), wherein the composition is essentially free of siloxanes and polysulfonic acids.

2. The method of claim 1 wherein the composition comprises up to 5 wt. % of water.

3. The method of claim 1 wherein the composition consists essentially of DPnP and water.

4. The method of claim 1 wherein the fabric is a garment.

5. The method of claim 1 wherein the fiber is wool fiber.

6. A method which comprises drycleaning a fabric using a composition comprising water and at least 95 wt. % of DPnP, wherein the composition is essentially free of siloxanes and polysulfonic acids.

7. The method of claim 6 wherein the composition comprises up to 5 wt. % of water.

8. The method of claim 6 wherein the fabric is a garment.

9. A method which comprises:

(a) tumbling garments in the presence of a cleaning composition comprising water and at least 95 wt. % of DPnP, wherein the composition is essentially free of siloxanes and polysulfonic acids;

(b) separating the garments from the cleaning composition; and (c) tumbling the garments in heated air to remove traces of the cleaning composition from the garments.

10. The method of claim 9 wherein the cleaning composition comprises up to 5 wt. % of water.

11. The method of claim 9 wherein the cleaning composition is reused after purifying it by adsorption, distillation, or a combination of these methods.

* * * * *